United States Patent [19]

Iizuka et al.

[11] Patent Number: 4,944,663

[45] Date of Patent: Jul. 31, 1990

[54] ROTARY COMPRESSOR HAVING OXIDIZING AND NITRIDING SURFACE TREATMENT

[75] Inventors: Tadashi Iizuka, Ashikaga; Kazushi Fukuda, Tochigi; Shin Ishihara, Kasukabe; Yasuo Kamitsuma, Mito; Yusaku Nakagawa, Hitachi, all of Japan

[73] Assignee: Hitachi, Ltd., Tokyo, Japan

[21] Appl. No.: 340,289

[22] Filed: Apr. 19, 1989

[51] Int. Cl.[5] ..... F04C 18/356

[52] U.S. Cl. ..... 418/178; 418/179; 428/472.2; 428/701

[58] Field of Search ..... 418/178, 179; 428/472.2, 701

[56] References Cited

U.S. PATENT DOCUMENTS 3,748,195 7/1973 Kondo et al. ..... 148/16.5

FOREIGN PATENT DOCUMENTS 122812 10/1976 Japan .

73082 4/1985 Japan .

13784 1/1987 Japan .

32293 2/1987 Japan ..... 418/179

191286 12/1988 Japan .

134093 5/1989 Japan ..... 418/179

*Primary Examiner*—Michael Koczo

*Assistant Examiner*—Douglas J. Makosy

*Attorney, Agent, or Firm*—Antonelli, Terry, Stout & Kraus

[57] ABSTRACT

A sliding member of an iron-based non-porous material, such as vane, of a rotary compressor has a sliding surface processed by a surface treatment in which the surface is subjected to oxidizing and nitriding to form an oxidized and nitrided layer thereon. The surface is then subjected to a steam-treatment in which water is caused to react with components of the oxidized and nitrided layer to form a layer of oxidized iron of a porous network structure disposed outwardly of the oxidized and nitrided layer. The oxidized iron layer is composed mainly of tri-iron tetroxide and softer than the oxidized and nitrided layer.

15 Claims, 4 Drawing Sheets

OXIDIZED AND NITRIDED SKH 51

OXIDIZED, NITRIDED AND STEAM-TREATED SKH 51

ROTARY COMPRESSOR HAVING OXIDIZING AND NITRIDING SURFACE TREATMENT

BACKGROUND OF THE INVENTION

The present invention relates to a compressor for use in an air-conditioner, a refrigerator or the like and, more particularly, to a technique of combining the materials of ferrous or iron-based sliding parts so as to provide them with abrasion-resistance and improved economic efficiency and thus allow them to be suitably used for high-performance, high-reliability rotary compressors.

Among the compressors that are used for air-conditioners, refrigerators and the like, there are various types including the rotary type, reciprocating type, scroll type and screw type. An explanation of the rotary type will be given here as a typical example of such compressors. A rotary compressor comprises a crankshaft rotatably supported by an upper bearing and a lower bearing, a roller rotatably mounted on a crank pin of the crankshaft, a cylinder for accommodating the roller, and a vane disposed slidably within a vane slot formed in the cylinder. A distal end portion of the vane is disposed in slidable engagement with an outer peripheral surface of the roller. The afore-mentioned sliding members of the compressor operate to compress Freon gas under the condition in which lubricant oil with Freon gas dissolved therein provides lubrication. Since these sliding members require an appropriately lubricated condition and an abrasion-resistance, the conventional compressor is designed, in general, to have iron-based sliding members, such as upper and lower bearings made of flake graphite cast iron or an iron-based sintered material, a crankshaft made of eutectic graphite cast iron, spheroidal graphite cast iron or flake graphite cast iron, a vane made of high-speed tool steel, and a cylinder formed from eutectic graphite cast iron or an iron-based sintered material.

However, in compact and high-output compressors of the variable speed control type which are capable of coping with the current tendency of air-conditioners and refrigerators to be provided with sophisticated functions and which employ such combination of the above-mentioned sliding members, a so-called boundary lubrication region in which metal-to-metal contact takes place due to break of oil film occurs during low-speed operations under high load and quick starting operations and in the operating condition in which the lubricating oil film is formed by low-viscosity refrigerator oil diluted with Freon. Consequently, since both the coefficient of friction and the abrasion loss increase, and since abrasion particles and fine foreign substances entering during fabrication accelerate the break of an oil film, the compressors tend to fall short of providing satisfaction in respect of the mechanical performances and the reliabilities.

To overcome the problem, the following several proposals have been made with a view to strengthening abrasion-resistance, but they each have their advantages and disadvantages and none of them are based on optimum combinations of materials that offer excellence in terms of both abrasion-resistance and productivity:

Japanese Patent Examined Publication No. 55-4958 discloses a rotary compressor which employs a combination of a cast iron cylinder and a soft-nitrided iron-based sintered alloy for the roller and the vane or for either one of them. In the soft-nitriding of a porous iron-based sintered alloy, nitriding reaction proceeds preferentially into the pores, while a change in configuration occurs to a large extent. This leads to the problem that it is difficult to effect reworking for the purposes of dimensional adjustment and removal of salt-bath components adhering to the alloy. Furthermore, since the pores and nitrides produce notch effect and the fatigue strength and mechanical strength are both low, such a combination of materials is inappropriate for driving parts to be employed in a compact, high-output and high-performance compressor.

Japanese Patent Unexamined Publication No. 60-73082 proposes a compressor which is characterized in that the internal surface of the cylinder is formed of an iron-based sintered alloy containing from 10 to 40 volume % of iron-based oxides, while the rotor and/or the vane is formed of an iron-based sintered alloy in which carbides of metal and oxides of metal are dispersed in a matrix formed by annealing martensite, and nitrogen is solidly dissolved in the matrix. Furthermore, the alloy component is restricted to iron, chromium, carbon, nickel, copper, or molybdenum and the material is sintered. However, as the constituent materials of a vane for use in a compact compressor with sophisticated functions that is required to have high output and high performance, these materials are appreciably inferior to conventional materials formed of molten metals in respect of mechanical strength and fatigue strength, as in the case of the aforementioned example.

Japanese Patent Unexamined Publication No. 62-13784 discloses a proposal in which a crankshaft is immersed in a salt bath mainly composed of a cyanate alkali metal salt, and a porous layer of iron nitride containing iron sulfide is formed thereon while a layer of an alloy formed of iron nitride is formed inside the porous layer. However, salt bath components of a high toxicity are liable to enter the porous portions and the oil ports in the crankshaft. Hence, unwashed portions of these components are liable to remain, and these components permeate the graphite contained in the cast iron, thus unfavorably resulting in blooming after treatment. Consequently, a process of strengthened washing is required, which necessitates a treatment for making non-polluting the waste solution left after washing. These processes appreciably adversely affect productivity and economic efficiency. In addition, in the cases where the treatment with salt bath and nitriding is effected, the surface-roughness of the crankshaft becomes relatively large, there is a further drawback that, with respect to precision parts such as compressor components which require control of dimensional accuracy on the order of several micron meters, reworking is required after processing so as to ensure dimensional accuracy. With respect to thermal stability of a combination of sliding members exposed to Freon and refrigerator oil, the iron sulfide component of the sulfided and nitrided layer is dissolved by its reaction with hydrochloric acid which is a decomposition product of Freon. Hence, there has been the drawback that this material is not suitable for use in high temperature environments.

For these reasons, there has been no optimum combination of sliding members available which offers a satisfactory performance for compact, high-output and high-performance compressors.

As described above, in the prior art, any proper consideration has not been given to the overall aspects of providing high-strength sliding parts for driving a compact, high-output and high-performance compressor, including satisfactory mechanical strength, adequate oil retaining properties, affinity to coexisting components, abrasion-resistance, production efficiency in terms of the need for complicated post-processings such as the washing-away of adhering salt-bath components and dimensional finishing, and so forth. Thus, in the field of compressors using Freon, there have been various problems in regard to the mechanical performance, such as the need for high-strength sliding materials for a compressor of a compact size and high performance, the need to minimize mechanical loss and maximize the volumetric efficiency of the compressor, as well as a demand for improvements in the long-term operational reliability and for a lowering of production costs and so forth.

SUMMARY OF THE INVENTION

It is an object of the present invention to provide a rotary compressor which overcomes the problems of the prior art discussed above.

It is another object of the present invention to provide a rotary compressor including sliding members at least one of which has an improved mechanical strength and can be made with an improved productivity and thus with an improved economy.

It is a further object of the present invention to provide a sliding member for use in a machine which has an improved mechanical strength, improved sliding characteristic and improved fitness relative to an associated machine component.

It is a still further object of the present invention to provide a method of preparing a sliding member of the class specified in the preceding paragraph.

According to an aspect of the present invention, there is provided a compressor which includes a cylinder, a roller disposed therein in an eccentric relationship thereto, a crankshaft for rotating the roller in the cylinder and a vane disposed in sliding engagement with the roller. At least one of the cylinder, the roller, the crankshaft and the vane comprises a member which is made from a ferrous or iron-based substantially non-porous material and which has a sliding surface comprising a first porous layer of oxidized iron backed up by a second layer of oxidized and nitrided iron disposed inwardly of the first layer. The term "substantially non-porous" is used herein to mean that the material has been produced by melting or is a sintered material having a density substantially the same as the ferrous material prepared by melting.

According to another aspect of the present invention, there is provided a machine including at least one pair of relatively slidable members at least one of which is made from a ferrous substantially non-porous material and has a sliding surface comprising a first layer of oxidized iron backed up by a second layer of oxidized and nitrided iron disposed inwardly of the first layer.

According to a further aspect of the invention, there is provided a method of making a sliding surface of a member of a machine. The method comprises the steps of preparing the member from a ferrous substantially non-porous material having a surface so machined as to be disposed in sliding engagement with an associated member of the machine, then subjecting the surface to an oxidizing and nitriding treatment whereby an oxidized and nitrided layer is formed on the surface, and, thereafter, subjecting the surface to a steam treatment in which water is caused to react with components of the oxidized and nitrided layer to form a porous layer of oxidized iron disposed outwardly of the oxidized and nitrided layer.

The ferrous non-porous material may be selected from a group consisting of conventional flake graphite cast iron, eutectic graphite cast iron, spheroidal graphite cast iron and high speed tool steel. Slidable machine components made from such ferrous material may be disposed in a container which is provided with a heating means. The machine components may then be subjected to an oxidizing and nitriding treatment in a mixture of ammonia gas and from 0.1 to 5.0% of air and at a temperature of from 450° to 650° C. whereby the surfaces of the machine components are formed thereon with oxidized and nitrided layers in which granular iron nitride and iron oxides coexist. The machine components may then be subjected to steam treatment at a temperature of from 300° to 800° C. to cause the components of the oxidized and nitrided layer of each machine component to react with water to thereby form thereon a mesh-like, porous and chemically stable tri-iron tetroxide layer which is of a thickness of from 0.1 to 10 μm and capable of sufficiently coping with a harsh lubricating condition in the machine in which the machine component is operated.

The "oxidizing and nitriding treatment" used herein is also called in the art by "oxynitriding treatment". Similarly, "oxidized and nitrided" is equivalent to "oxynitrided".

In particular, in order to effect processing thinly and uniformly on the surface portion, it is preferable to use a non-porous, dense metallic material prepared by melting or a liquid-phase sintered product having an equivalent density. It is not desirable to use an iron-based sintered metal having a porous matrix since the processing proceeds deep into the interior of the material, resulting in the formation of an internal strain, a reduction in mechanical strength, a decline in the degree of the surface roughness and a decrease in dimensional accuracy. Thus, it is necessary to substantially limit the percentages of defective parts, such as cavities and pores, to 5% or less.

The porous iron oxide layer and the inner oxidized and nitrided layer that are formed on the outermost surface of a slidable member of the compressor function as follows: (1) In a harsh boundary lubricating condition, the porous layer is operative to retain the low-viscosity refrigerator oil with Freon dissolved in it to rapidly recover break of the oil film due to permeation-action of oil;

(2) The porous iron oxide layer exhibits a plastic flow in conformity with the configuration of an associated sliding surface, establishes a good affinity therewith and can be easily brought into contact therewith to reduce the actual pressure at the sliding surface;

(3) Since the iron oxide layer chiefly composed of tri-iron tetroxide hardly undergoes solid solution and diffusion relative to the matrix of an associated slidable member, it is possible to obtain effects of non-adhesiveness and non-seizure with respect to the associated sliding surface.

(4) Since tri-iron tetroxide is chemically stable, the tendency of deterioration in the quality of the refrigerator oil can be suppressed even when the compressor is operated under high temperature conditions. In addition, corrosive abrasion is unlikely to occur.

(5) The inner hard oxidized and nitrided layer forms an alloy layer of iron, nitrogen and oxygen in the case of cast iron, and a nitrogen-diffused layer with iron nitride dispersed therein in the case of high-speed steel. In both cases, the layer is hard and functions to assure adhesion to the porous iron oxide and to prevent cracking thereof. Even if worn particles produced due to the contact between metals and fine hard foreign substances entering during assembly should enter between sliding surfaces, the hard layer is effective to force these foreign substances into the iron matrix of an associated sliding member which is not processed. This offers an advantage that any damage to the porous iron oxide layer can be held to a minimum.

For the foregoing reasons, the present invention makes it possible to overcome seizure and adhesion between sliding members and appreciably improve abrasion-resistance and coefficient of friction in a harsh boundary lubricating condition of the compressor, thereby to enhance the mechanical performance of the compressor and its reliability in use over an extended period of time.

In addition, in accordance with the method of the present invention, the conventional inexpensive molten metallic materials can be used as they are, changes in the surface roughness and in the configuration and dimensions are held down to low levels due to decrease in the thickness of processed layer, and the washing and non-polluting treatment processes can be eliminated. Accordingly, productivity is improved, and the economic advantage is brought about in reducing the unit prices of components and, hence, the production cost of the compressor. In particular, a remarkable improvement can be obtained when the surface treatment in accordance with the present invention is effected to the iron-based slidable members, such as the vane of high-speed tool steel, the roller and the crankshaft formed of eutectic graphite cast iron, flake graphite cast iron or nodular graphite cast iron, and if these members are combined with stationary members of an iron-based sintered material or cast iron.

DESCRIPTION OF THE PREFERRED EMBODIMENTS

Referring now to FIGS. 1 to 9, a description will be made of an embodiment of the present invention.

Figure 2:
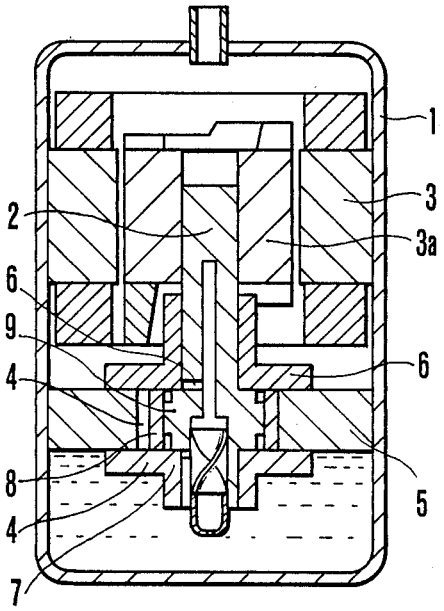
FIG. 2 is a vertical cross-sectional view of a rotary Freon compressor.
Figure 3:
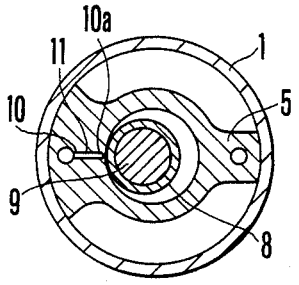
FIG. 3 is a cross-sectional view of the compressing shown in FIG. 2.
Figure 4:
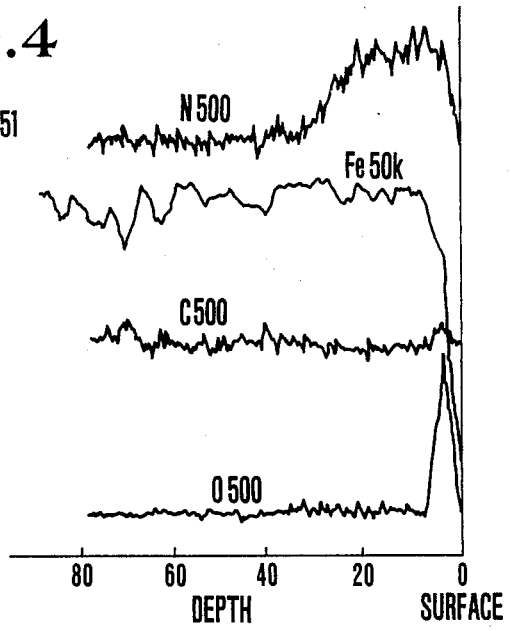
FIG. 4 is an X-ray analysis diagram of a cross section of an oxidized and nitrided component.
Figure 7:
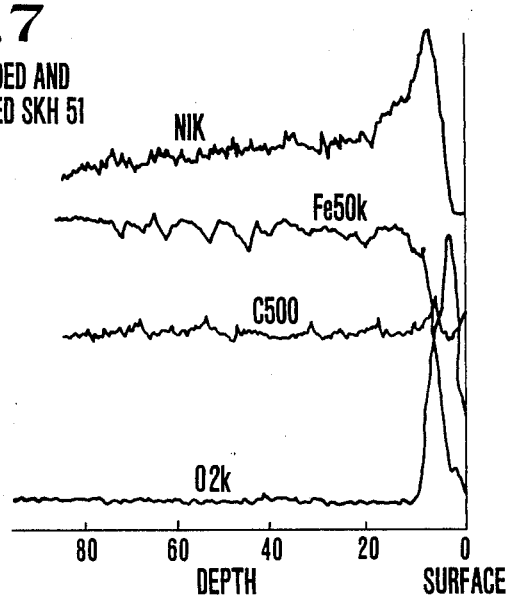
FIG. 7 shows the result of X-ray analysis of the cross section of the sample shown in FIG. 5.
Figure 5:
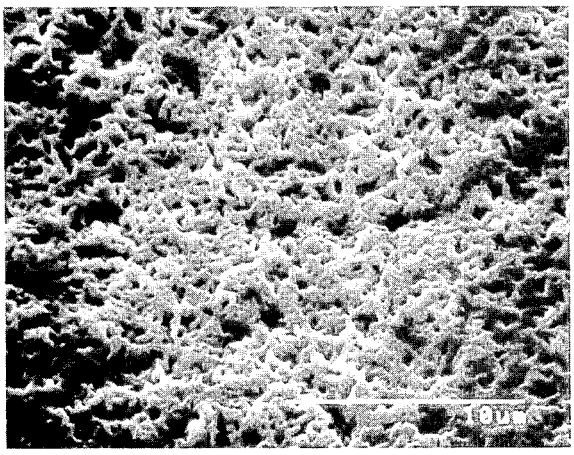
FIG. 5 is a photograph showing the metal structure of an oxidized, nitrided and steam-treated surface magnified by 4,000 times by an electron microscope.

Referring to FIGS. 2 and 3, a description will be first made of a rotary compressor to which the present invention is applied. The rotary compressor comprises a hermetic container 1, a crankshaft 2, a motor section 3, and a compressor section 4.

As shown in FIG. 2, the compressor section 4 comprises a cylinder 5, an upper bearing 6, a lower bearing 7, a roller 8 disposed in the cylinder in an eccentric relationship thereto, a crankshaft pin 9 and a vane 10. The crankshaft 2 is journaled by the upper bearing 6 and the lower bearing 7. The crankshaft pin 9 imparts an eccentric rotatary motion to the roller 8. The vane 10 is slidably received in a vane slot portion 11 formed in the cylinder 5 and has an end portion **10*a* disposed in slidable contact with the outer peripheral surface of the roller 8 so that the vane 10 is reciprocally moved as the roller 8** is rotated.

In recent years, a speed control system has come to be adopted for these sliding parts by reflecting the tendency of air-conditioners and refrigerators to be made compact and provided with sophisticated functions. Thus, the operations of the sliding members are controlled over a wide range from a low speed to a high speed. Problems involved in boundary lubrication are liable to occur between the crankshaft pin 9 and the roller 8, between the vane slot portion 11 in the cylinder 5 and the vane 10, and between the tip **10*a* of the vane and the roller 8**. The conventional iron-based sliding parts formed from steel or cast iron have a problem that they lack oil-retaining properties and abrasion-resistance accompanied by affinity. The conventional surface-treatment methods are not practical since they fail to provide sufficient mechanical strength and abrasion-resistance of the material as well as the productivity of the slidable members. In contrast, the compressor in accordance with the present invention is improved to advantageously overcome the break of oil films even in a boundary lubricating condition since porous iron oxide layers, each composed mainly of tri-iron tetraoxide on the order of several micron meters, are formed on the sliding surfaces of iron-based sliding members made of conventional molten material which is dense and has high mechanical properties, and a hard oxidized and nitrided layer is formed inwardly of each porous iron oxide film layer, as will be evident from the explanation that follows.

In a preferred embodiment of the method of the present invention, works are first placed in a container which is provided with heating means The container is then closed and sealed against the atmosphere. Thereafter, nitrogen gas is introduced into the container to substitute for the air initially contained in the container until the oxygen content in the container becomes less than 0.1%. Then, the heating means is operated to gradually raise the temperature in the container to a level of from 450° to 650° C. The temperature is kept at this level until the materials of the works in the container are uniformly heated up to this level. Then, the nitrogen gas in the container is replaced by a mixture of from 95.0 to 99.9% of ammonia gas and from 0.1 to 5.0% of air while the temperature in the container is kept at that level. The works are exposed to the gaseous mixture for a while to subject the sliding surfaces of the works to oxidizing and nitriding treatment whereby the sliding surfaces are each formed thereon with an oxidized and nitrided layer in which substantially granular iron oxide and iron nitride coexist. Thereafter, the heating means is turned off and fresh nitrogen gas is introduced into the container to substitute for the gaseous mixture, to thereby gradually lower the temperature in the container to a predetermined level (100° C., for example). The heating means is then operated again to raise the temperature in the container to a level of from about 300° to about 800° C. When the materials of the works in the container are uniformly heated, water is introduced into the container at a small rate to produce steam therein. The water of the steam react with components of the oxidized and nitrided layer to form a second layer of porous network structure disposed outwardly of the oxidized and nitrided layer. The second layer is composed mainly of tri-iron tetroxide. Then, the heating means is turned off and fresh nitrogen gas is introduced into the container to substitute for the gases therein to gradually lower the temperature in the container. When the container temperature is lowered to a level lower than about 150° C., the container is opened to subject the treated works to an air-cooling by the ambient air.

Figure 1:
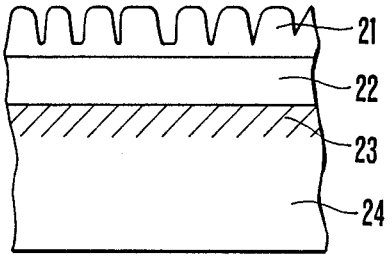
FIG. 1 is an enlarged cross-sectional view of a surface-treated member illustrating a porous iron oxide layer and an oxidized and nitrided layer.

FIG. 1 diagrammatically illustrates, in an enlarged scale, the pattern of a cross section of a work thus treated, wherein reference numeral 21 designates the aforementioned second layer of porous network structure mainly composed of tri-iron tetroxide. This second layer 21 is backed up by the first oxidized and nitrided layer 22 disposed inwardly of the second layer. In a matrix 24 of the treated work is formed a third layer 23 which is disposed inwardly of the first layer 22 and in which nitrogen is diffused.

EXAMPLES

Conventional high-speed tool steel SKH 51 will be described first as a typical example. A vane was formed from ingot SKH 51 steel and refined by quenching and annealing by the standard heat treatment of JIS (Japanese Industrial Standard) and, then, was subjected to treatment at 540° C. for 40 minutes in an ammonium gas containing 4% of air. As is apparent from the X-ray analysis of the cross section shown in FIG. 4 and the X-ray diffraction image of the surface layer shown in FIG. 6, oxides and nitrides containing granular iron oxides were produced on the surface layer. Then, the vane was subjected to steam-treatment at 450° C. for 30 minutes. The granular iron oxides swelled, thereby forming a layer of tri-iron tetroxide of porous network structure, as shown in the surface photograph in FIG. 5. This can be readily confirmed from the X-ray analysis shown in FIG. 7 and the X-ray diffraction image shown in FIG. 8. The strength of the iron oxide layer chiefly composed of tri-iron tetroxide was as high as HMV 300–600 (in terms of micro Vickers hardness) and the strength of the oxidized and nitrided layer disposed inwardly of the iron oxide layer was as high as HMV 600–1300. Thus, the iron oxide layer and the oxidized and nitrided layer display a sufficient strength as compared with the hardness of HMV 300 or less of non-treated iron-based sliding members. It can be appreciated that, in cases where the same sliding surfaces are relatively slid repeatedly as in compressors, the iron oxide layer exhibits a plastic flow in conformity with the configuration of an associated sliding surface and the hard oxidized and nitrided layer causes fine hard foreign substances to be embedded in the associated sliding surface, thereby establishing a state of close sliding contact. This is called an initial fitness property which reduces the pressure at the sliding surface.

Figure 9:
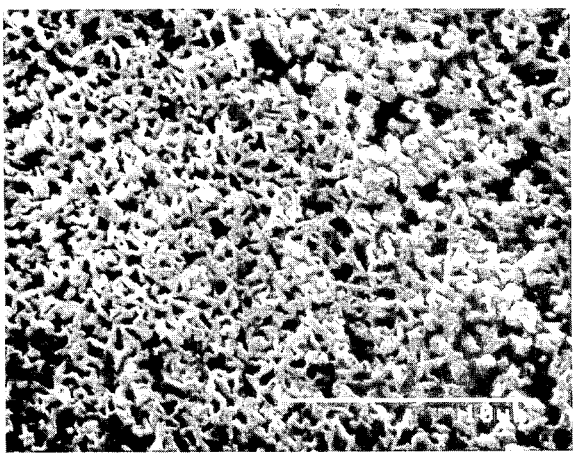
FIG. 9 is a photograph showing the metal structure of an oxidized, nitrided and steam-treated surface of an eutictic graphite cast iron magnified by 4,000 times by an electron microscope.
Figure 6:
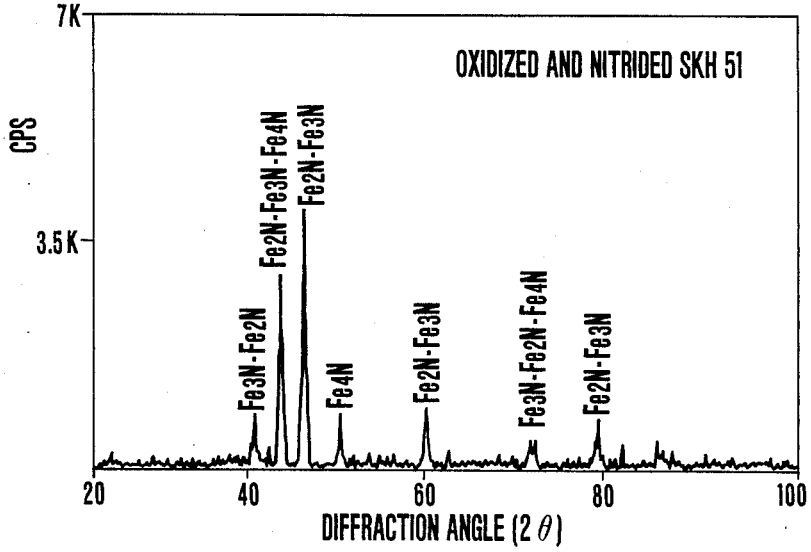
FIG. 6 is a cross-sectional X-ray diffraction diagram of the sample shown in FIG. 5.
Figure 8:
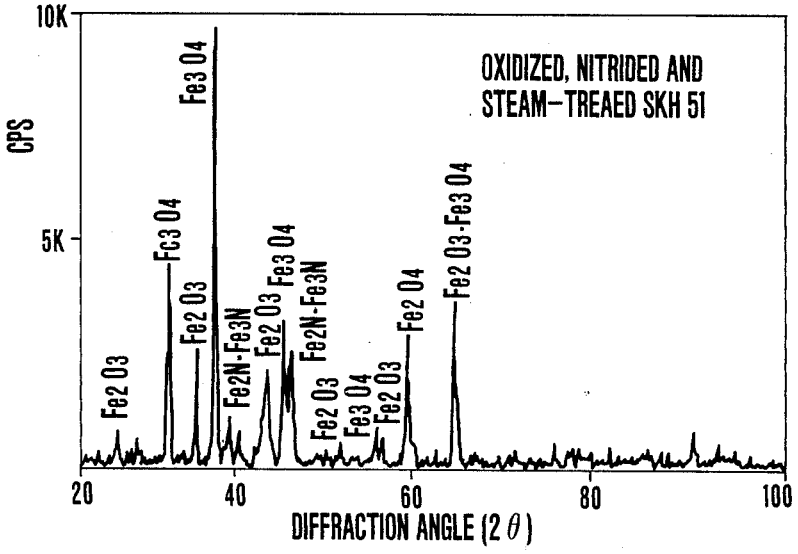
FIG. 8 is an X-ray diffraction diagram of the surface shown in FIG. 5.

FIG. 9 shows the surface of a crankshaft fabricated from an eutectic graphite cast iron FCE 20 which was similarly subjected to steam treatment after oxidizing and nitriding. In this case as well, a porous iron oxide layer was obtained. The material was placed upright in a mixed solution of 70% of Freon 113 and 30% naphthene-based mineral oil to examine the penetration height of the liquid. The liquid penetrated 30–50% higher in the case of this treated material by means of capillary action as compared with a non-treated material. In other words, the porous surface portion retains the oil film, and even if the oil film breaks, the porous portion is capable of quickly recovering the oil film and improving its resistance to abrasion, adhesion and seizure.

In addition, the tri-iron tetroxide formed on the surface does not have a solid solution and diffusiveness to an associated iron-based sliding member and, thus, has advantageous properties that make adhesion and seizure difficult to take place. In addition, this material is chemically stable and resistant to corrosion and to oil and refrigerating medium, i.e., the layer of the material is capable of remaining stable on a frictional sliding surface exposed to high temperatures Referring now to Table 1, a description will be made of the practical characteristics (concerning abrasion resistance) of iron-based sliding members of the compressor treated to form the porous mesh-like tri-iron tetroxide layers and the oxidized and nitrided layers on their surfaces.

TABLE 1

| | | Combination of Sliding Members | Amount of Wear | Friction Coefficient | Form of Friction |
|---|---|---|---|---|---|
| Example 1 | Vane | Oxidized, nitrided and steam-treated SKH 51 | less than 0.5 | 0.01 | Abrasive |
| | Cylinder | FCE 20 | 1 | | |
| Prior Art 1 | Vane | SKH 51 | 1 | 0.06 | Adhesive |
| | Cylinder | FCE 20 | 100 | | |
| Example 2 | Vane | Oxidized, nitrided and steam-treated SKH 51 | less than 0.5 | 0.01 | Abrasive |
| | Roller | FCC 25* | 1 | | |
| Prior Art 2 | Vane | SKH 51 | 1 | 0.04 | Adhesive |
| | Roller | FCC 25* | 100 | | |
| Example 3 | Shaft | Oxidized, nitrided and steam-treated FCU 20 | 1 | 0.01 | Abrasive |
| | Roller | Quality-adjusted FCC 25* | 1 | | |
| Prior Art 3 | Shaft | Mangane phosphate-treated FCE 20 | 100 | 0.01 | Abrasive |
| | Roller | Quality-adjusted FCC 25* | 1 | | |
| Comparative Example A | Shaft | Sulphurized and nitrided FCE 20 | 2 | 0.01 | Abrasive |
| | Roller | Quality-adjusted FCC 25* | 1 | | |

TABLE 1-continued

| | | Combination of Sliding Members | Amount of Wear | Friction Coefficient | Form of Friction |
|---|---|---|---|---|---|
| Example 4 | Roller | Oxidized, nitrided, steam-treated and quality adjusted FCC 25* | less than 0.5 | 0.01 | Abrasive |
| | Upper bearing | FC 20 | 1 | | |
| Prior Art 4 | Roller | Quality-adjusted FCC 25* | 1 | 0.02 | Abrasive |
| | Upper bearing | FC 20 | 5 | | |
| Example 5 | Roller | Oxidized, nitrided, steam-treated and quality-adjusted FCC 25* | less than 0.5 | 0.01 | Abrasive |
| | Lower bearing | SMF 4030** | 1 | | |
| Prior Art 5 | Roller | Quality-adjusted FCC 25* | 1 | 0.02 | Abrasive |
| | Lower bearing | SMF 4030** | 5 | | |

*"FCC 25" means a cast iron FC 25 fabricated by continuous casting.
**"SMF 4030" means a sintered ferrous material 4030 under JIS (Japanese Industrial Standard). (See JIS Z 2550).

The evaluation of practical use in respect of abrasion resistance was based on an experiment conducted by using a Suzuki-type abrasion testing machine in which boundary lubrication was forcedly caused to take place in a low-viscosity naphthene-based refrigerator oil in which Freon 113 $C2Cl_3F_3$ having characteristics similar to those of Freon 12 $CCl_2F_2$ and Freon $22CHClF_2$ was dissolved under the conditions of a peripheral speed of 5.7 m/s and a load of 75 kgf/cm$^2$ so as to approximate the conditions to those of the practical use of rotaty compressors. The assessment was made on the basis of the amount of wear, the coefficient of friction and the forms of the abrasive surfaces of cylindrical testpieces.

With the combination of the oxidized, nitrided and steam-treated vane material formed of high-speed tool steel SKH 51 and the cylinder material formed of eutective graphite cast iron FCE 20 of Example 1, as compared with the combination of the non-treated materials of Prior Art 1, the amount of wear of the vane was ½ of that of the non-treated vane and the coefficient of friction was 1/6, while the amount of wear of the cylinder was 1/100. As for the form of abrasion, an improvement was made from the adhesive type to the normal abrasion. Thus, the table shows that abrasion resistance can be improved substantially. In other words, the abrasion resistance of the soft cylinder (HMV: approx. 200) formed from eutectic graphite cast iron FCE 20 is substantially improved due to the oil-retaining properties, affinity and non-adhesive and non-seizing properties of the above-described porous mesh-like iron oxide layer and the inner oxidized and nitrided layer.

With the combination of the oxidized, nitrided and steam-treated vane material of high-speed tool steel SKH 51 and the quality-adjusted roller material of eutectic graphite cast iron FCC 25, as compared with the combination of non-treated materials of the Prior Art 2, the wear of the roller material was reduced to 1/100 and the coefficient of abrasion to ¼. The form of abrasion was improved from the adhesive type to the normal abrasion. These improvements were for the same reasons, as those discussed in connection with the foregoing example.

The combination of the crankshaft formed of eutectic graphite cast iron FCE 20 and the modified roller formed of FCC 25 is shown in Example 3. As compared with the manganese phosphate-treated parts of the Prior Art 3, it was possible to reduce the amount of wear of the shaft material to 1/100. On the other hand, it was found that, as compared with the sulphurized and nitrided parts shown in Comparative Example A, the amount of exfoliation of the porous layer was smaller and the amount of the initial wear was held to the value of ½.

As the reason for remarkable improvement in the amount of wear and the coefficient of friction by both the porous iron oxide layer and the oxidized and nitrided layer, it can be pointed out that the low-viscosity lubricating oil with Freon dissolved in it was adsorbed by the porous iron oxide layer, thereby demonstrating oil-retaining properties and affinity and preventing the adhesion and seizure of the sliding surface occurring due to break of an oil film. Furthermore, it can be seen that the mechanical strength of the oxidized and nitrided layer having a sufficient hardness and its adhesion to the matrix and the iron oxide layer prevents damage to the porous iron oxide layer with respect to fine worn particles and hard fine foreign substances entering between the sliding surfaces.

In addition, with respect to dimensional stability, test pieces both formed of high-speed tool steel and both finished with a surface roughness of Rmax 0.5 μm were subjected to a sulphurizing and nitriding treatment and to an oxidizing and nitriding treatment, for the same period of time, with a result that the surface roughness was Rmax. 2.5 μm in the former case and Rmax. 1.0 μm in the latter. Thus, it was found that the oxidized and nitrided parts exhibit a small degree of surface roughness and can be put into practical use as they are, i.e., without any reworking for dimensional adjustment. That is, since the post-processing can be eliminated, the economic advantages can be obtained.

Table 2 shows the evaluation of thermal stability of Freon 12 and naphthane-based refrigerator oil used with oxidized, nitrided parts and steam-treated parts. Table 2 shows that the parts subjected to steam treatment after oxidizing and nitriding, as compared with non-treated part and sulphurized and nitrided parts, have the effect of reducing the change in the hue of oil and the decomposition of the refrigerant to thereby assure a high reliability when used at high temperatures.

TABLE 2

| | Mixing Conditions | | Material | Change in oil hue | Freon decomposition |
|---|---|---|---|---|---|
| Example 6 | Freon 12<br>Naphthene-based mineral oil | 1 g<br>1 g | Oxidized, nitrided and steam-treated pure iron | O | 0.2% |
| Prior Art 6 | Freon 12<br>Naphthene-based mineral oil | 1 g<br>1 | Pure iron alone | Δ | 1.6% |
| Comparative Example B | Freon 12<br>Naphthene-based mineral oil | 1 g<br>1 g | Sulphurized and nitrided pure iron | X | 3.5% |

X: Large change in hue
Δ: Small change in hue
O: Medium change in hue

In accordance with the present invention, the surface treatment in accordance with the present invention can be easily effected on the surfaces of conventional inexpensive iron-based sliding parts. Since the residual salt washing-away process and the non-polluting treatment process necessary for the conventional soft nitriding and sulphurizing and nitriding using a slat bath, and the reworking process for dimensional adjustment can be eleminated, productivity can be improved and economic advantages can be obtained.

It is apparent that the present invention can be applied not only to all types of compressors, including a reciprocating compressor, rotary compressor, scroll compressor, screw compressor and swash plate type compressor but also to any types of machines that have at least one pair of members disposed in sliding engagement.

What is claimed is:

1. A compressor including a cylinder, a roller disposed therein in an eccentric relationship thereto, a crankshaft for rotating said roller in said cylinder and a vane disposed in sliding engagement with said roller, at least one of said cylinder, said roller, said crankshaft and said vane comprising a member which is made from a ferrous substantially non-porous material and which has a surface disposed in relative sliding engagement with an associated member, said surface comprising a first porous layer of oxidized iron backed up by a second layer of oxidized and nitrided iron disposed inwardly of said first layer.

2. A compressor according to claim 1, wherein said crankshaft has a pin portion on which said roller is rotatably mounted and wherein said cylinder is formed therein with a vane slot in which said vane is slidably received and has an end disposed in sliding engagement with an outer peripheral surface of said roller.

3. A compressor according to claim 1, wherein said first porous layer is composed mainly of tri-iron tetroxide.

4. A compressor according to claim 2, wherein said first porous layer is composed mainly of tri-iron tetroxide.

5. A compressor according to claim 2, wherein said one member is the vane and wherein said vane is made of a high speed tool steel.

6. A compressor according to claim 5, wherein said cylinder is made of a cast iron.

7. A compressor according to claim 5, wherein said roller is made of a cast iron.

8. A compressor according to claim 1, wherein said one member is the crankshaft and wherein said crankshaft is made of a cast iron.

9. A compressor according to claim 2, wherein said one member is the crankshaft and wherein said crankshaft is made of a cast iron.

10. A compressor according to claim 9, wherein said roller is made of a quality-adjusted cast iron.

11. A compressor according to claim 1, further including upper and lower bearings each having a first portion rotatably supporting said crankshaft and a second portion disposed in relatively sliding engagement with said roller.

12. A compressor according to claim 11, wherein said one member is the roller and said upper bearing is formed of a cast iron.

13. A compressor according to claim 11, wherein said one member is the roller and wherein said lower bearing is formed of a sintered ferrous material.

14. A machine including at least one pair of relatively slidable members at least one of which is made from a ferrous substantially non-porous material and has a surface disposed in relatively sliding engagement with an associated member, said surface comprising a first layer of oxidized iron backed up by a second layer of oxidized and nitrided iron formed in said one member inwardly of said first layer.

15. A machine according to claim 14, wherein said first layer has a porous network structure and is composed mainly of tri-iron tetroxide.

* * * * *